US012454742B2

(12) United States Patent
Fehrmann

(10) Patent No.: US 12,454,742 B2
(45) Date of Patent: Oct. 28, 2025

(54) ALUMINUM ALLOY

(71) Applicant: Fehrmann GmbH, Hamburg (DE)

(72) Inventor: Henning Fehrmann, Hamburg (DE)

(73) Assignee: Fehrmann GmbH, Hamburg (DE)

( * ) Notice: Subject to any disclaimer, the term of this patent is extended or adjusted under 35 U.S.C. 154(b) by 222 days.

(21) Appl. No.: 15/733,311

(22) PCT Filed: Dec. 21, 2018

(86) PCT No.: PCT/EP2018/086645
§ 371 (c)(1),
(2) Date: Jun. 24, 2020

(87) PCT Pub. No.: WO2019/129722
PCT Pub. Date: Jul. 4, 2019

(65) Prior Publication Data

US 2021/0189526 A1 Jun. 24, 2021

(30) Foreign Application Priority Data

Dec. 28, 2017 (EP) ..... 17210899

(51) Int. Cl.

| | |
|---|---|
| ***C22F 1/047*** | (2006.01) |
| ***B22D 21/04*** | (2006.01) |
| ***C22C 1/02*** | (2006.01) |
| ***C22C 21/08*** | (2006.01) |

(52) U.S. Cl.
CPC ..... *C22C 21/08* (2013.01); *B22D 21/04* (2013.01); *C22C 1/026* (2013.01); *C22F 1/047* (2013.01)

(58) Field of Classification Search
CPC ..... C22C 21/08; C22C 1/026; C22C 21/06
See application file for complete search history.

(56) References Cited

U.S. PATENT DOCUMENTS

| | | | | |
|---|---|---|---|---|
| 3,989,548 | A * | 11/1976 | Morris | C30B 21/02 148/438 |
| 5,423,925 | A * | 6/1995 | Shoji | C22F 1/047 148/692 |
| 5,846,350 | A | 12/1998 | Bergsma | |
| 6,994,759 | B1 * | 2/2006 | Koch | C22C 21/06 148/549 |
| 2001/0002240 | A1 | 5/2001 | Suzuki | |
| 2009/0038720 | A1 | 2/2009 | Lumley et al. | |
| 2014/0255249 | A1 | 9/2014 | Abe et al. | |
| 2017/0165795 | A1 * | 6/2017 | Lenczowski | B22F 9/08 |
| 2018/0190316 | A1 | 7/2018 | Kitawaki et al. | |
| 2020/0325559 | A1 | 10/2020 | Fehrmann | |

FOREIGN PATENT DOCUMENTS

| | | | | |
|---|---|---|---|---|
| CN | 103031473 A * | 4/2013 | | |
| JP | H0987771 | 3/1997 | | |
| JP | 2013-129909 | 7/2013 | | |
| JP | 2021508782 | 3/2021 | | |
| KR | 101159410 B1 * | 2/2012 | | |
| WO | 2016/034857 | 3/2016 | | |
| WO | WO-2016034857 A1 * | 3/2016 | | C22C 1/026 |
| WO | 2016/190277 | 12/2016 | | |
| WO | 2017/191961 | 11/2017 | | |

OTHER PUBLICATIONS

Chen M, CN-103031473-A machine translation, Apr. 10, 2013 (Year: 2013).*
Takaki et al., KR-101159410-B1 machine translation, Jun. 28, 2012 (Year: 2012).*
O. M. Gorodkova, Effect of the Melting Conditions on the Corrosion Cracking Resistance of Cast Magnalium Alloys, 1989, Fiziko-Khimicheskaya Mekhanika Materialov, No. 1, Plenum Publishing Corporation, pp. 48-51 (Year: 1989).*
https://web.archive.org/web/20161007013117/https://www.makeitfrom.com/material-properties/520.0-520.0-T4-formerly-220.0-LM10-G10A-A05200-Cast-Aluminum, 520.0 (520.0-T4, formerly 220.0, LM10, G10A, A05200) Cast Aluminum, Oct. 7, 2016 MakeItFrom.com, WayBackMachine (Year: 2016).*
Indian Office Action issued Jul. 5, 2021 in Indian Application No. 202017031821, with partial English translation, 7 pages.
Japanese Office Action issued Sep. 7, 2021 in Japanese Application No. 2020-536779, with English translation, 14 pages.
Japanese Office Action dated Apr. 26, 2022 in Japanese Application No. 2020- 536779, with English translation, 12 pages.
Chinese Office Action dated Apr. 28, 2022 in Chinese Application No. 201880083742.1, with English translation, 22 pages.
Xie Shuisheng, "Concise Handbook of Aluminum Alloy Processing", Metallurgical Industry Press, Dec. 31, 2016, pp. 302-303.
International Search Report issued Apr. 9, 2019 in PCT/EP2018/086645.
Written Opinion issued Apr. 9, 2019 in PCT/EP2018/086645.
Extended European Search Report issued Apr. 3, 2018 in European Application No. 17210899.5.
Anilchandra et al., Materials 2017, 10, 1011, 12 pages.
Boyko et al., "Characterization of the structure and precipitation process in Al—Mg—Si and Al—Mg—Ge casting Alloys", Jan. 1, 2015 (Jan. 1, 2015), XP055574702, Retrieved from the Internet: URL:https://depositonce.tu-berlin.de/bitst.ream/11303/4632/1/boyko viidoriya.pdf on Mar. 28, 2019, 152 pages.
Office Action and Search Report issued May 8, 2021 in Chinese Application No. 201880083742.1 with English translation, 18 pages.
Shaogang Wang, "Fundamentals of Engineering Materials and Forming Technology 2nd Edition", National Defence Industry Press, Jun. 30, 2016, pp. 139-140.
Korean Office Action dated Jul. 31, 2022, in Korean Application No. 10-2020-7021529, with English translation, 8 pages.

(Continued)

*Primary Examiner* — Anthony M Liang
(74) *Attorney, Agent, or Firm* — Grüneberg and Myers PLLC

(57) ABSTRACT

The present disclosure relates to an alloy containing aluminum and magnesium, a method for the preparation of the alloy, a method for the preparation of a product containing the alloy, and a product containing the alloy. An aluminium alloy having good mechanical properties, in particular high tensile strength, high yield strength and high elongation, while allowing the use of the alloy in both casting and forming processes is disclosed.

18 Claims, 4 Drawing Sheets

(56) References Cited

OTHER PUBLICATIONS

Indian Office Action dated Sep. 18, 2023, in Indian Application No. 202017031821, with English translation, 2 pages.

* cited by examiner

ALUMINUM ALLOY

CROSS-REFERENCE TO RELATED APPLICATIONS

This application is a National Stage entry under § 371 of International Application No. PCT/EP2018/086645, filed on Dec. 21, 2018, and which claims the benefit of European Application Ser. No. 17/210,899.5, filed on Dec. 28, 2017, the content of both of which are hereby incorporated by reference in their entireties.

BACKGROUND OF THE INVENTION

Field of the Invention

The present disclosure relates to an alloy containing aluminum and magnesium, a method for the preparation of said alloy, a method for the preparation of a product comprising said alloy, and a product comprising said alloy.

Discussion of the Background

Aluminum is a very light weight and, at the same time, relatively cheap material. Therefore, more and more workpieces are made from aluminum when a low weight is of importance such as in automobile construction. However, when compared to widely used steel, aluminum has certain constraints regarding the mechanical properties.

An aluminum workpiece may be prepared in different ways. Standard methods currently use different kinds of casting methods and forming methods in the preparation and shaping of workpieces. While casting methods allow for the faster and easier production of complex pieces, forming methods using wrought alloys may have advantages, in particular regarding mechanical properties of the final workpiece. The advantages of the wrought alloys may be seen in the possibility of the stability of the aluminum alloy being directly adjustable via additives (such as solid solution hardening or precipitation hardening), heat treatment, solidification and constant cooling, which measures are not available as such for casting methods. On the other hand, casting methods have advantages in near net shape manufacture and forming of components with complex geometry using a process way from the raw materials to the final casting, in less finishing efforts and no need for re-forming or welding techniques.

SUMMARY OF THE INVENTION

There is still a need for an aluminum alloy that may be used in casting and forming methods, allowing for the preparation of aluminum products having good mechanical properties, in particular good tensile strength, good yield strength and good elongation.

It has now been found out that the aluminum alloys of the present disclosure have good mechanical properties, in particular high tensile strength, high yield strength and high elongation, while allowing the use of the alloy in both casting and forming processes.

In a first aspect, the present disclosure relates to an aluminum alloy comprising a. from 9 to 14% by mass of magnesium (Mg);
b. from 0.011 to 1% by mass of titanium (Ti);
c. 0.1% by mass or less of manganese (Mn);
d. 0.1% by mass or less of iron (Fe);
e. from 0.001 to 0.1% by mass of beryllium (Be);

f. from 0.0009 to 0.2% by mass of boron (B); and
g. 0.01% by mass or less of copper (Cu);

with the balance being aluminum (Al);

each in relation to the total mass of the alloy composition, and wherein all compounds of the alloy add up to a total of 100% by mass.

A second aspect of the present disclosure relates to a method for the preparation of an aluminum alloy according to the first aspect as disclosed above, comprising the steps of a. Providing a raw aluminum;
b. Heating the raw aluminum to a temperature in the range of from 650 to 800° C., preferably from 700 to 770° C.;
c. Adding Mg and Be to result in a raw alloy;
d. Optionally degassing the raw alloy;
e. Adding Ti and B to the optionally degassed raw alloy to prepare the aluminum alloy in liquid form.

In a third aspect, the present disclosure relates to a method for the manufacture of an aluminum casting, comprising the steps of f. Casting the liquid aluminum alloy into a mold;
g. Removing the mold to provide an aluminum casting;
h. Optionally forming and/or treating the aluminum casting.

A fourth aspect of the present disclosure relates to an aluminum alloy product comprising or consisting of an aluminum alloy according to the first aspect, and/or being prepared by a method according to the third aspect, wherein i) at least parts of the product have a thickness in the range of from 1 to 23 mm, or 3 to 15 mm, or from 6 to 12 mm, or from 6 to 9 mm; or 1 to 10 mm, or 3 to 10 mm; and/or
ii) the aluminum of the product has a tensile strength of at least 290 MPa, or at least 320 MPa, or at least 360 MPa, or at least 370 MPa, or at least 380 MPa; and/or
iii) the aluminum of the product has a yield strength of at least 170 MPa, or at least 180 MPa, or at least 200 MPa, or at least 215 MPa; and/or
iv) the aluminum of the product has elongation of at least 5%, or at least 15%, or at least 20%, or at least 30%, or at least 34%.

A fifth aspect of the present disclosure relates to an aluminum alloy product prepared, obtained or obtainable by a method according to the third aspect.

DETAILED DESCRIPTION OF THE INVENTION

Figure 1:
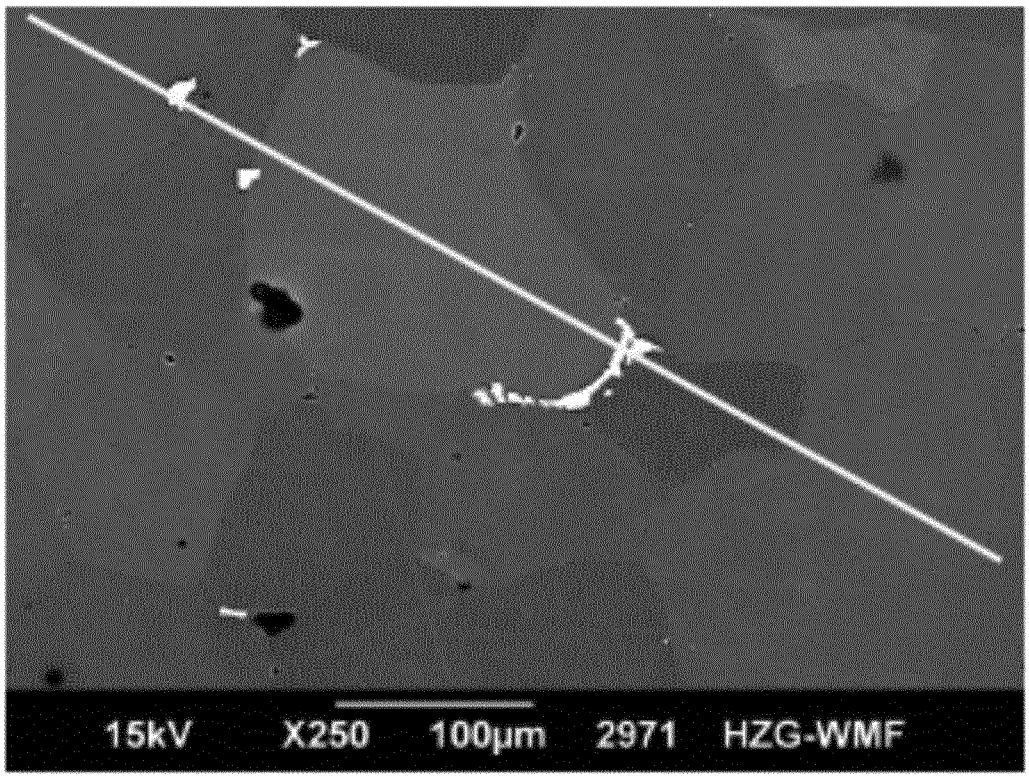
FIG. 1: Electron microscopical picture of a cross section of the sample of Example 2 after homogenization.
Figure 2A:
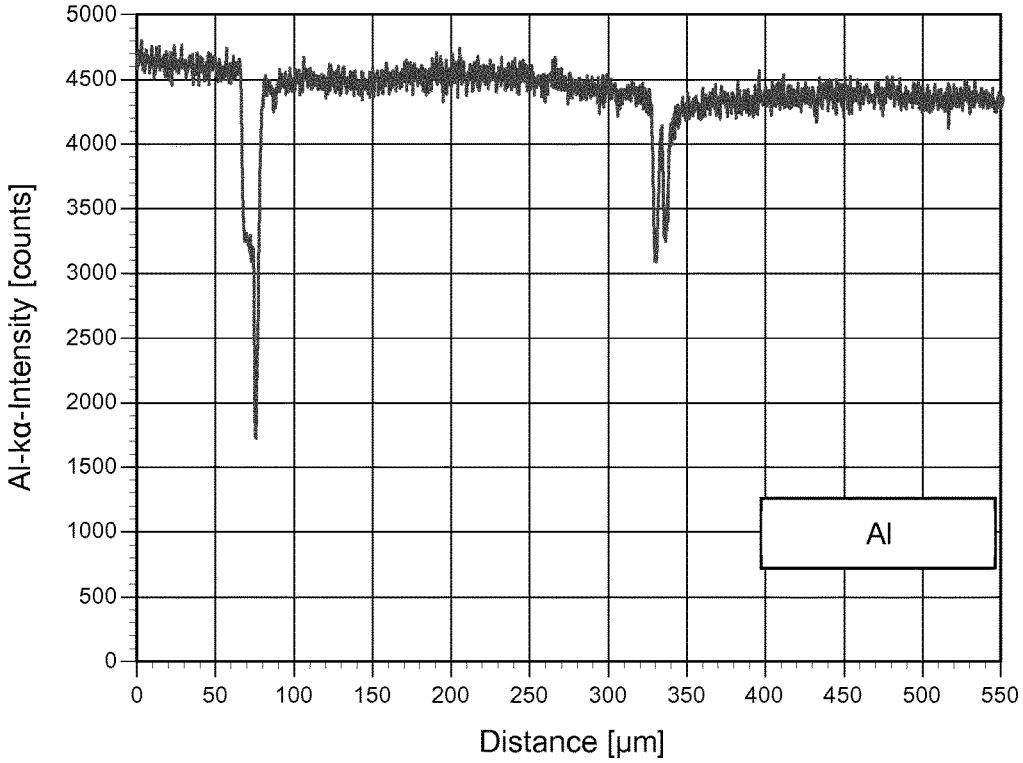
FIG. 2: EDX analysis showing distribution of a) aluminum, b) magnesium, c) iron, and d) copper along the line indicated in FIG. 1.
Figure 2B:
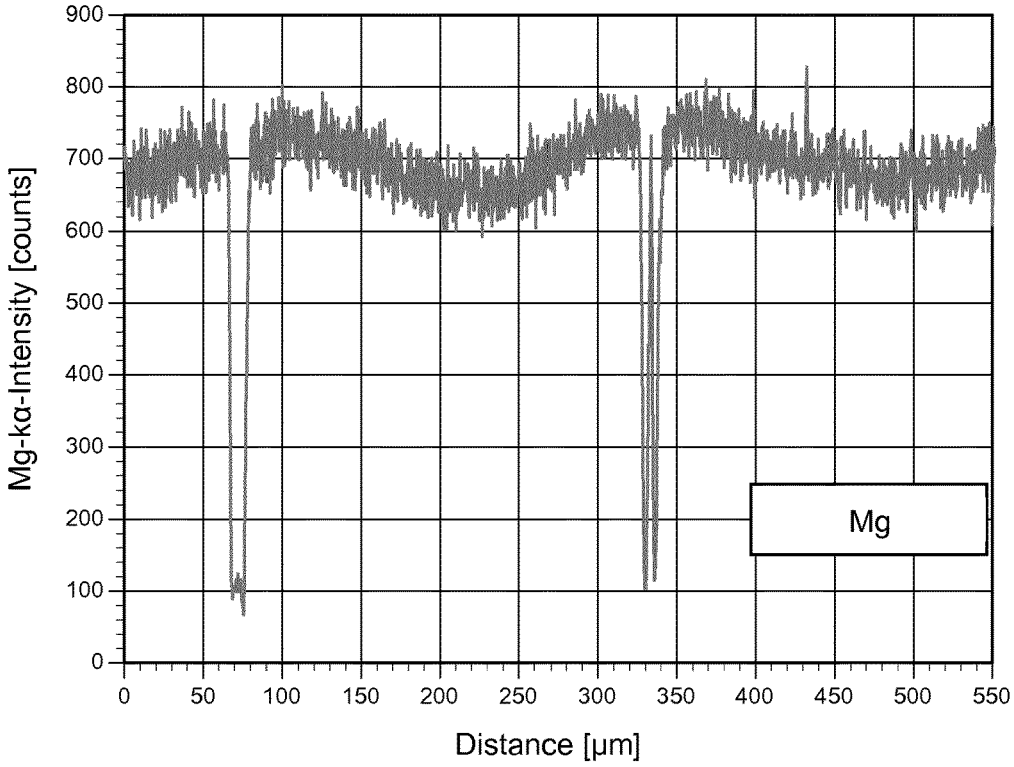
Figure 2C:
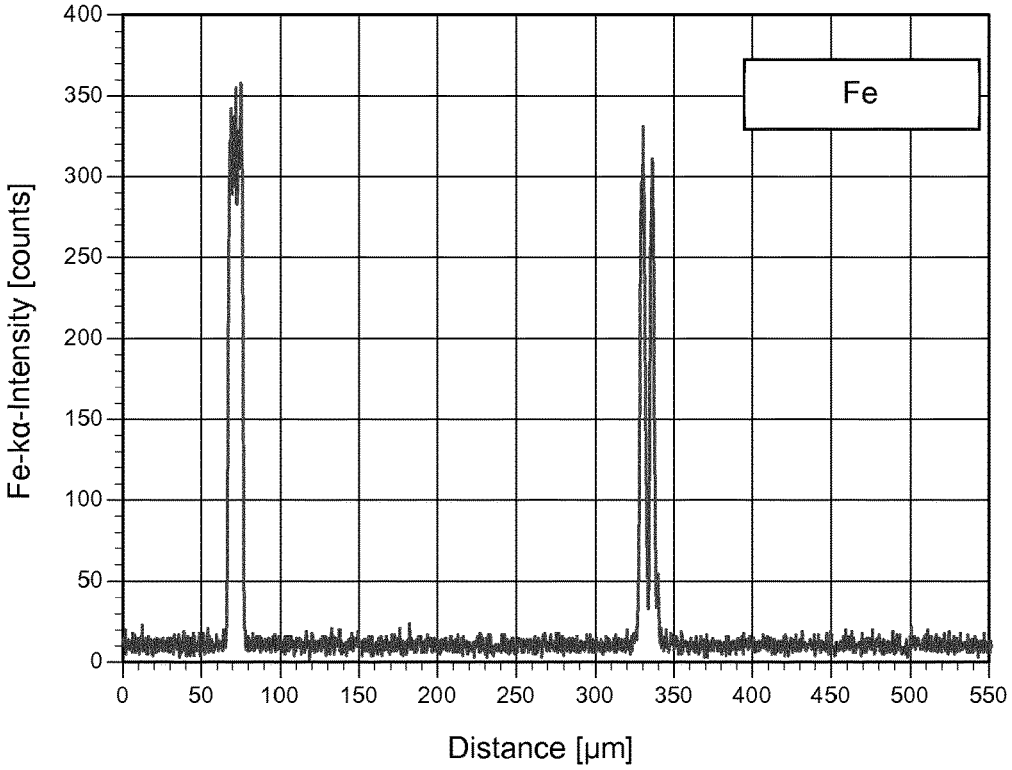
Figure 2D:
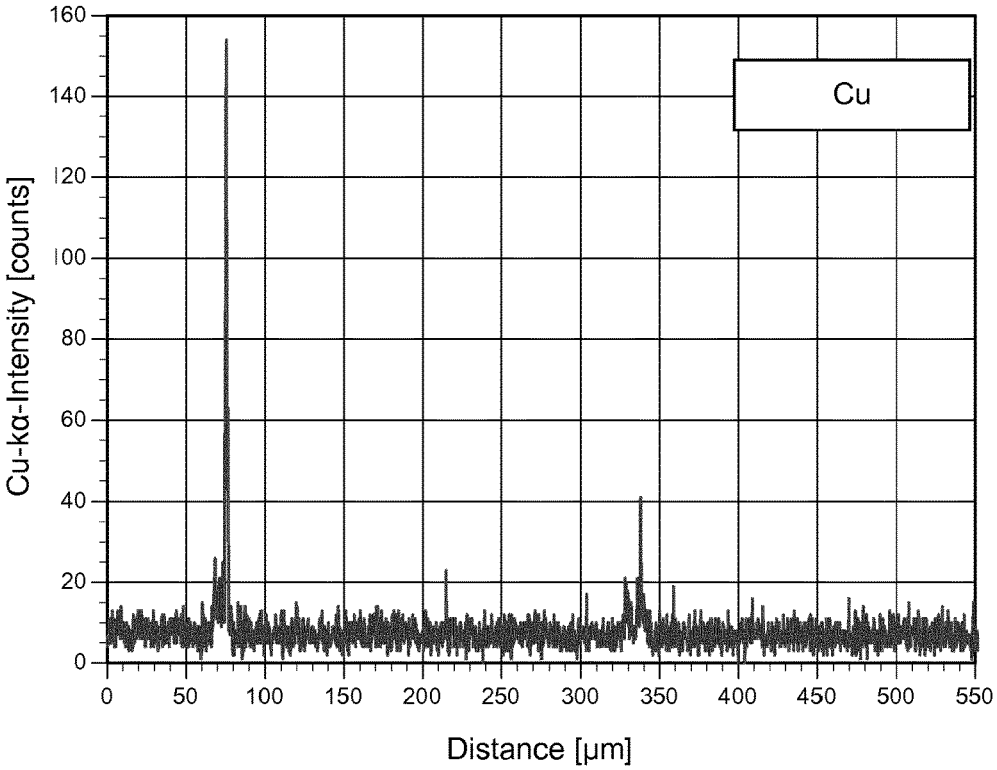

In a first aspect, the present disclosure relates to an aluminum alloy comprising a. from 9 to 14% by mass of magnesium (Mg);
b. from 0.011 to 1% by mass of titanium (Ti);
c. 0.1% by mass or less of manganese (Mn);
d. 0.1% by mass or less of iron (Fe);
e. from 0.001 to 0.1% by mass of beryllium (Be);
f. from 0.0009 to 0.2% by mass of boron (B); and
g. 0.01% by mass or less of copper (Cu);

with the balance being aluminum (Al);

each in relation to the total mass of the alloy composition, and wherein all compounds of the alloy add up to a total of 100% by mass.

It has been found that the aluminum alloy of the first aspect has high tensile strength ($R_m$), high yield strength ($R_{p0.2}$) and good elongation (A). In particular, when the resulting body made of the alloy of the present disclosure has a thickness in the range of from 1 to 23 mm, or from 1 to 10 mm, the material has a high tensile strength, a high yield strength and good elongation.

In a preferred embodiment of the first aspect, the aluminum alloy comprises inevitable impurities. It is known in the art that the process of preparing aluminum almost inevitably results in the presence of impurities, such as other metals. Even though the level of impurity is preferably very low, or even non-existent, the presence of impurities may be inevitable in some cases.

In a further preferred embodiment, the inevitable impurities are present in an amount of less than 0.15% by mass, or in an amount of less than 0.1% by mass, or in an amount of less than 0.05% by mass. This relates to the total amount of impurities as present in the alloy.

In another preferred embodiment, each individual impurity is present in an amount of less than 0.05% by mass, or in an amount of less than 0.01% by mass, or in an amount of less than 0.001% by mass, or in an amount of less than 0.0001% by mass. If more than one impurity is present, each impurity is termed as "individual impurity". The amount of each individual impurity is preferably less than the respective given amount, and the sum of the amounts of each individual impurity results in the total amount of impurities.

One of these individual impurities may be scandium (Sc), resulting in an amount of Sc of less than 0.05% by mass, or in an amount of less than 0.01% by mass, or in an amount of less than 0.001% by mass, or in an amount of less than 0.0001% by mass.

Another one of these individual impurities may be calcium (Ca), resulting in an amount of Ca of less than 0.05% by mass, or in an amount of less than 0.01% by mass, or in an amount of less than 0.001% by mass, or in an amount of less than 0.0001% by mass.

Still another one of these individual impurities may be chromium (Cr), resulting in an amount of Cr of less than 0.05% by mass, or in an amount of less than 0.01% by mass, or in an amount of less than 0.001% by mass, or in an amount of less than 0.0001% by mass.

Other examples of individual impurities include zirconium (Zr), vanadium (V) or phosphor (P).

As one of the essential elements, the aluminum alloy of the present disclosure contains magnesium (Mg) as a main ingredient in an amount of from 9 to 14% by mass. In a preferred embodiment of the first aspect, Mg is present in an amount of from 9.1 to 13.9% by mass, or in an amount of from 9.2 to 13% by mass, or in an amount of from 9.5 to 12% by mass, or in an amount of from 9.8 to 11% by mass, or in an amount of from 10.2 to 11.8% by mass, or in an amount of from 10.2 to 13% by mass, or in an amount of from 9.2 to 10.2% by mass, or in an amount of from 9.6 to 10.2% by mass.

Another essential element in the composition of the aluminum alloy of the present disclosure is titanium (Ti), present in an amount of from 0.011 to 1% by mass. In a preferred embodiment, Ti is present in an amount of from 0.011 to 0.9% by mass, preferably in an amount of from 0.012 to 0.8% by mass, preferably in an amount of from 0.013 to 0.5% by mass, or in an amount of 0.011% by mass or more. In another preferred embodiment, Ti is present in an amount of 0.015% by mass or more, or in an amount of 0.15% by mass or more, or in an amount of 0.2% by mass or more, or in an amount of 0.3% by mass or more. In still another preferred embodiment, Ti is present in an amount of 0.9% by mass or less, or in an amount of 0.8% by mass or less, or in an amount of 0.7% by mass or less, or in an amount of 0.6% by mass or less, or in an amount of 0.4% by mass or less.

The aluminum alloy of the present disclosure contains manganese (Mn) at an amount of 0.1% by mass or less. In a preferred embodiment, Mn is present in an amount of 0.09% by mass or less, or in an amount of 0.08% by mass or less, or in an amount of 0.04% by mass or less, or in an amount of 0.005% by mass or less. In still another embodiment, it is advantageous if small amounts of Mn are present, and is may be preferred that Mn is present in in an amount of 0.0001% by mass or more, or in an amount of 0.0005% by mass or more.

Also iron (Fe) is present in the aluminum alloy of the present disclosure at low amounts of 0.1% by mass or less. In a preferred embodiment, Fe is present in an amount of 0.09% by mass or less, or in an amount of 0.08% by mass or less, or in an amount of 0.05% by mass or less, or in an amount of 0.03% by mass or less. In still another embodiment, it is advantageous if small amounts of Fe are present, and is may be preferred that Fe is present in an amount of 0.01% by mass or more, preferably in an amount of 0.05% by mass or more.

Another element in the aluminum alloy of the present disclosure—apart from aluminum—is beryllium (Be), present in an amount of from 0.001 to 0.1% by mass. In a preferred embodiment, Be is present in an amount of from 0.002 to 0.09% by mass, or in an amount of from 0.003 to 0.08% by mass, or in an amount of from 0.007 to 0.06% by mass. In another preferred embodiment, Be is present in an amount of 0.002% by mass or more, or in an amount of 0.003% by mass or more, or in an amount of 0.004% by mass or more, or in an amount of 0.005% by mass or more, or in an amount of 0.015% by mass or more. In still another embodiment, Be is present in an amount of 0.09% by mass or less, or in an amount of 0.08% by mass or less, or in an amount of 0.07% by mass or less, or in an amount of 0.06% by mass or less, or in an amount of 0.04% by mass or less.

In a preferred embodiment of the present disclosure, Ti an B are added to the aluminum alloy melt together, further preferably in bars containing Ti and B in a ration of Ti:B of 5:1. However, the ration of Ti and B in the final alloy may differ from the ratio of Ti and B when added to the melt. Without being bound to said theory, it is assumed that some of the B is removed when removing the foam from the melt. Said foam is removed as it contains agglomerated impurities which are not desired in the final alloy. It is furthermore assumed that B is enriched in said foam, in particular in relation to Ti, due to the low specific weight of B. As such, it is preferred that the ration of Ti:B in the final alloy is in the range of 5:1 to 10:1, and it is further preferred that the ratio is 5:1 or 10:1, preferably 10:1.

In a preferred embodiment of the aluminum alloy of the present disclosure, boron (B) is present in an amount of from 0.0009 to 0.2% by mass, or in an amount of from 0.001 to 0.15% by mass, or in an amount of from 0.006 to 0.1% by mass, or in an amount of from 0.01 to 0.1% by mass, or in an amount of from 0.015 to 0.05% by mass. In another preferred embodiment, B is present in an amount of 0.0009% by mass or more, or in an amount of 0.001% by mass or more, or in an amount of 0.006% by mass or more, or in an amount of 0.03% by mass or more. In still another embodiment, B is present in an amount of 0.1% by mass or less, or in an amount of 0.08% by mass or less, or in an amount of 0.07% by mass or less, or in an amount of 0.06% by mass or less, or in an amount of 0.04% by mass or less.

In another embodiment, silicon (Si) is present in an amount of 1% by mass or less, or in an amount of 0.5% by mass or less, or in an amount of 0.3% by mass or less, or in an amount of 0.2% by mass or less, or in an amount of 0.15% by mass or less, or in an amount of 0.1% by mass or less. In still another embodiment, Si is present in an amount of 0.01% by mass or more, or in an amount of 0.03% by mass or more, or in an amount of 0.05% by mass or more, or in an amount of 0.07% by mass or more.

In another embodiment, copper (Cu) is present in an amount of 0.01% by mass or less, or in an amount of 0.005% by mass or less, or in an amount of 0.003% by mass or less. In still another embodiment, Cu is present in an amount of 0.0001% by mass or more, or in an amount of 0.0005% by mass or more.

In another embodiment, zinc (Zn) is present in an amount of 0.01% by mass or less, or in an amount of 0.008% by mass or less, or in an amount of 0.007% by mass or less. In still another embodiment, Zn is present in an amount of 0.001% by mass or more, preferably in an amount of 0.003% by mass or more.

In an embodiment, the present disclosure relates to an aluminum alloy, comprising a. from 9 to 14% by mass of Mg;
b. from 0.011 to 1% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.5 to 12% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.5 to 12% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.3% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.5 to 12% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.3% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.5 to 12% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;

g. from 0.03 to 0.5% by mass of Si, preferably from 0.003 to 0.3% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising
a. from 10.2 to 11.8% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising
a. from 10.2 to 11.8% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising
a. from 10.2 to 11.8% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising
a. from 10.2 to 11.8% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising
a. from 10.2 to 11.8% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 10.2 to 11.8% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 10.2 to 11.8% by mass of Mg;
b. from 0.013 to 0.5% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 10.2 to 11.8% by mass of Mg;
b. from 0.013 to 0.5% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.013 to 0.5% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

In an embodiment, the present disclosure relates to an aluminum alloy, comprising a. from 9.6 to 10.2% by mass of Mg;
b. from 0.013 to 0.5% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;

h. 0.01% by mass or less of Cu; and i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

The above outlined aluminum alloy of the first aspect may be used, in all its embodiments and—were reasonable—combination of embodiments, in the following aspects of the present disclosure.

A second aspect of the present disclosure relates to a method for the preparation of an aluminum alloy according to the first aspect as disclosed above, comprising the steps of a. Providing a raw aluminum;

b. Heating the raw aluminum to a temperature in the range of from 650 to 800° C., preferably from 700 to 770° C.;

c. Adding Mg and Be to result in a raw alloy;

d. Optionally degassing the raw alloy;

e. Adding Ti and B to the optionally degassed raw alloy to prepare the aluminum alloy in liquid form.

The raw aluminum is preferably provided having a low amount of impurities, preferably having a level of impurity of 0.3% by mass or below. The raw aluminum is then heated in a furnace to a temperature melting the aluminum, but not heating the aluminum too high, in particular not above 900° C., in order to avoid the formation of excess oxidation products. It is therefore preferred to heat the raw aluminum to a temperature in the range of from 650 to 800° C., preferably from 700 to 770° C., further preferably from 720 to 750° C. Prior to the addition of the raw aluminum to the furnace, the furnace may be pre-heated, preferably to a temperature in the range of from 400 to 900° C.

Once the raw aluminum is melted, Mg and Be are added. As these metals are added in solid form, the temperature of the melt will drop. It is therefore preferred to re-heat the aluminum melt to a previously defined temperature or temperature range, or to maintain the previously defined temperature or temperature range during addition of the metals. Further optional elements, such as Mn, Fe, Cu, Zn or Si, may be added during this step.

The resulting raw aluminum alloy may then optionally be degassed using usual measures. In a preferred embodiment, the degassing may be supported by argon gas as purging gas.

After the addition of the above listed elements, and the optional degassing step, Ti and optionally B are added in a final step. The final aluminum alloy melt may then be cast, e.g., to blocks for further or later processing, such as in the method of the third aspect, or it may be directly used starting from step b. of the method of the third aspect.

In a third aspect, the present disclosure relates to a method for the manufacture of an aluminum casting, comprising the steps of f. Casting the liquid aluminum alloy into a mold;

g. Removing the mold to provide an aluminum casting;

h. Optionally forming and/or treating the aluminum casting.

The liquid aluminum alloy is prepared according to the second aspect of the disclosure. The aluminum alloy of the present disclosure may be used in any known casting method, and the casting method is not limited by the aluminum of the present application. In particular, it may be used in any known casting method used for standard AlMg10 aluminum alloys. The liquid aluminum alloy may be cast into a mold. After cooling the mold, it may be removed, providing a casting comprising the aluminum alloy of the present disclosure. The casting may then optionally be further processed in a usual and known manner.

Accordingly, the aluminum alloy of the present disclosure may be used for casting and forming of aluminum product, in particular for the preparation of castings.

In a preferred embodiment of the third aspect, the casting is selected from the group consisting of sand casting, plaster mold casting, shell casting, lost-wax casting, evaporative-pattern casting (e.g., lost foam casting or full-mold casting), permanent mold casting, die casting (preferably pressure die casting), semi-solid metal casting, centrifugal casting, and continuous casting.

In another preferred embodiment of the third aspect, the casting is heat treated in step h. by heating the casting to a temperature of at least 380° C., or at least 400° C., or at least 430° C., or at least 450° C., for a period of less than 1 hour, or less than 3 hours, or less than 5 hours, or less than 8 hours, or less than 12 hours, or less than 18 hours, or less than 24 hours, preferably less than 12 hours, or preferably less than 18 hours, or for a period of at least 10 minutes, or at least 1 hour, or at least 3 hours, or at least 8 hours, or at least 12 hours, or at least 24 hours, and then cooled in air at ambient temperature (e.g., a temperature in the range of 20 to 25° C.). Said heat treating step may optionally be applied in addition to a forming step, prior to or after said forming step. Alternatively, if a forming step is not desired, only a heat treatment may be (optionally) applied to the casting. Without being bound by any theory, it is assumed that during said heat treatment, a phase transition takes place in the aluminum alloy, increasing the tensile strength, the yield strength, and/or the elongation of the casting.

In another preferred embodiment of the third aspect, the aluminum casting is formed by a method selected from the group consisting of rolling, extruding, die forming, forging, stretching, bending and shear forming.

In a further preferred embodiment of the third aspect, the liquid aluminum alloy and/or the aluminum casting is characterized by low or no formation of dross (i.e. aluminum dross). Aluminum dross may occur upon exposition of liquid aluminum alloy and/or molten aluminum casting to air. A longer exposition to air promotes an enhanced formation of dross. In a preferred embodiment of the third aspect, liquid aluminum alloy and/or molten aluminum casting is characterized by low or no formation of dross over a long-term exposition to air (e.g., 8 hours). The formation of dross may be visible to the bare eye and/or detectable by any technical method applicable thereto (e.g., spectral analysis).

A fourth aspect of the present disclosure relates to an aluminum alloy product comprising or consisting of an aluminum alloy according to the first aspect, and/or being prepared by a method according to the third aspect, wherein i) at least parts of the product have a thickness in the range of from 1 to 23 mm, or 3 to 15 mm, or from 6 to 12 mm, or from 6 to 9 mm; or 1 to 10 mm, or 3 to 10 mm; and/or ii) the aluminum of the product has a tensile strength of at least 290 MPa, or at least 320 MPa, or at least 360 MPa, or at least 370 MPa, or at least 380 MPa; and/or iii) the aluminum of the product has a yield strength of at least 170 MPa, or at least 180 MPa, or at least 200 MPa, or at least 215 MPa; and/or iv) the aluminum of the product has elongation of at least 5%, or at least 15%, or at least 20%, or at least 30%, or at least 34%.

According to a preferred embodiment of the fourth aspect, i) the aluminum of the product has a tensile strength, measured at a thickness of from 1 to 23 mm, or 3 to 15 mm, or from 6 to 12 mm, or from 6 to 9 mm; or 1 to 10 mm, or 3 to 10 mm, of at least 290 MPa, or at least 320 MPa, or at least 360 MPa, or at least 370 MPa, or at least 380 MPa; and/or ii) the aluminum of the product has a yield strength, measured at a thickness of from 1 to 23 mm, or 3 to 15 mm, or from 6 to 12 mm, or from 6 to 9 mm; or 1 to 10 mm, or 3 to 10 mm, of at least 170 MPa, or at least 180 MPa, or at least 200 MPa, or at least 215 MPa; and/or iii) the aluminum of the product has elongation, measured at a thickness of from 1 to 23 mm, or 3 to 15 mm, or from 6 to 12 mm, or from 6 to 9 mm; or 1 to 10 mm, or 3 to 10 mm, of at least 5%, or at least 15%, or at least 20%, or at least 30%, or at least 34%.

According to another preferred embodiment of the fourth aspect, i) at least parts of the product have a thickness in the range of from 1 to 10 mm, or 3 to 10 mm, or from 6 to 9 mm; and/or ii) the aluminum of the product has a tensile strength of at least 380 MPa, or at least 400 MPa, or at least 420 MPa; and/or iii) the aluminum of the product has a yield strength of at least 200 MPa, or at least 215 MPa; and/or iv) the aluminum of the product has elongation of at least 20%, or at least 24%.

According to another preferred embodiment of the fourth aspect, i) the aluminum of the product has a tensile strength, measured at a thickness of from 1 to 10 mm, or 3 to 10 mm, or from 6 to 9 mm, of at least 380 MPa, or at least 400 MPa, or at least 420 MPa; and/or ii) the aluminum of the product has a yield strength, measured at a thickness of from 1 to 10 mm, or 3 to 10 mm, or from 6 to 9 mm, of at least 200 MPa, or at least 215 MPa; and/or iii) the aluminum of the product has elongation, measured at a thickness of from 1 to 10 mm, or 3 to 10 mm, or from 6 to 9 mm, of at least 20%, or at least 24%.

According to another preferred embodiment of the fourth aspect, i) at least parts of the product have a thickness in the range of from 1 to 23 mm, or 3 to 15 mm, or from 6 to 12 mm, or from 6 to 9 mm; and/or ii) the aluminum of the product has a tensile strength of at least 290 MPa, or at least 320 MPa, or at least 360 MPa, or at least 370 MPa, or at least 380 MPa; and/or iii) the aluminum of the product has a yield strength of at least 170 MPa, or at least 180 MPa; and/or iv) the aluminum of the product has elongation of at least 5%, or at least 15%, or at least 20%, or at least 30%, or at least 34%.

According to another preferred embodiment of the fourth aspect, i) the aluminum of the product has a tensile strength, measured at a thickness of from 1 to 23 mm, or 3 to 15 mm, or from 6 to 12 mm, or from 6 to 9 mm, of at least 290 MPa, or at least 320 MPa, or at least 360 MPa, or at least 370 MPa, or at least 380 MPa; and/or ii) the aluminum of the product has a yield strength, measured at a thickness of from 1 to 23 mm, or 3 to 15 mm, or from 6 to 12 mm, or from 6 to 9 mm, of at least 170 MPa, or at least 180 MPa; and/or iii) the aluminum of the product has elongation, measured at a thickness of from 1 to 23 mm, or 3 to 15 mm, or from 6 to 12 mm, or from 6 to 9 mm, of at least 15%, or at least 20%, or at least 30%, or at least 34%.

A fifth aspect of the present disclosure relates to an aluminum alloy product prepared, obtained or obtainable by a method according to the third aspect.

As will also be obvious from the Examples below, the aluminum alloy of the present disclosure has a high tensile strength, a high yield strength, and a high elongation, in particular at a thickness in the range of from 1 to 23 mm.

Definition of Terms

The present invention as illustratively described in the following may suitably be practiced in the absence of any element or elements, limitation or limitations, not specifically disclosed herein.

The present invention will be described with respect to particular embodiments and with reference to certain figures but the invention is not limited thereto but only by the claims. Terms as set forth hereinafter are generally to be understood in their common sense unless indicated otherwise.

Where the term "comprising" is used in the present description and claims, it does not exclude other elements. For the purposes of the present invention, the term "consisting of" is considered to be a preferred embodiment of the term "comprising". If hereinafter a group is defined to comprise at least a certain number of embodiments, this is also to be understood to disclose a group, which preferably consists only of these embodiments. Furthermore, if a composition is defined using the term "comprising", it may additionally comprise other elements not explicitly listed, however, not further amounts of an element listed. As such, if, e.g., an aluminum alloy comprises Mg in an amount of 14% by mass, said aluminum alloy may comprise elements other than Mg, however, not additional amounts of Mg, thereby exceeding the amount of 14% by mass.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that e.g. an embodiment must be obtained by e.g. the sequence of steps following the term "obtained" even though such a limited understanding is always included by the terms "obtained" or "defined" as a preferred embodiment.

As used herein, the terms "impurity" and "impurities" refer to and comprises elements in the alloy which are inevitably present due to, e.g., the manufacturing process of the alloy or the manufacturing process of the raw material(s). An impurity is not explicitly mentioned in the list of elements in the alloy, however, an element may turn from an impurity to an essential element in the alloy. If, e.g., an element is not mentioned in a more general definition of the composition of an alloy, it may be present as an impurity, and the same element may be mentioned as a compulsory compound in a more specific definition of the composition of the alloy.

The aluminum alloy of the present disclosure is composed of different components. These components are explicitly listed in the composition of the alloy, or they are part of the impurities present in the alloy. In any case, if a component is defined as an amount in % by mass, the figure reflects the relative amount (as mass) in percent based on the total mass of the alloy composition.

In some embodiments, "at least parts" of a product or workpiece have a thickness in a defined range. In this context, "at least parts" refers to at least 1%, or at least 3%, or at least 5%, or at least 10% of the entire surface of the product or workpiece. The thickness of the product or workpiece may be determined at each point of the surface of the product or workpiece by measuring the shortest distance across the product or workpiece. By integration over the entire surface, the "part" of the product or workpiece having a thickness in the defined range may be calculated.

EXAMPLES

Example 1: Preparation of Aluminum Alloys

All aluminum alloys were prepared in an electrical induction furnace (Inductotherm, model V.I.P. Power Trak 150), which was preheated to a temperature of about 300° C. over a period of about 15 minutes. After the furnace has reached a temperature of about 300° C., 60 kg of raw aluminum (with 0.3% by mass or less of total impurities; from MTX Aluminium Werke GmbH, Lend, Austria).

The raw aluminum was heated to 720 to 750° C. and the respective amounts of Mg (from DEUMU Deutsche Erz- and Metall-Union GmbH, Germany, pure magnesium, at least 99.9%) and Be (added as pellets of AlBe, containing 5% by mass of Be, the remainder being Al, from Hoesch Metals, Niederzier, Germany) were added. After re-heating to 720 to 750° C., the melt was de-gassed for 10 minutes with Argon gas as purging gas using an injection lance.

Then, at a temperature in the range of 650 to 750° C., Ti and B are added as bars containing Ti and B in a ratio of 5:1 (added as pellets of AlTi5B1, containing 5% by mass of Ti, 1% by mass of B, the remainder being Al, from Foseco-Vesuvius, Germany). The pellets are stirred into the liquid alloy, and immediately after mixing, the crucible is removed from the furnace and the liquid alloy is cast into a respective mold.

Without being bound to any theory, it is assumed that some of the boron is removed by removing the foam from the top of the melt since boron has a low specific density, in particular in relation to titanium, explaining the ratio of about 10:1 of Ti:B in the final alloy. The remaining elements are present in the alloy as impurities from the starting materials.

TABLE 1

| No. | Mg | Ti | B | Si | Be | Mn | Cu | Zn | Fe |
|---|---|---|---|---|---|---|---|---|---|
| 1 | 9.98 | 0.016 | 0.001 | 0.057 | 0.005 | 0.001 | 0.001 | 0.005 | 0.035 |
| 2 | 10.44 | 0.319 | 0.032 | 0.058 | 0.015 | 0.001 | 0.001 | 0.005 | 0.069 |
| 3 | 10.91 | 0.303 | 0.0046 | 0.050 | 0.015 | 0.00088 | <0.00002 | 0.0027 | 0.032 |

All amounts are given in % by mass. The balance to the compositions disclosed in Table 1 is aluminum.

Example 2: Heat Treatment

The mechanical properties of alloy No. 1 of Example 1 were investigated with respect to the type of casting and an optional heat treatment.

Cylindrical samples having a diameter of 14 mm were cast from alloy No. 1 of Example 1 in a sand mold. The samples were subjected to tests determining the tensile strength ($R_m$), the yield strength ($R_{p0.2}$) and the elongation (A). The measuring length was 84 mm for the sand mold casting.

Identical samples as prepared above were subjected to a heat treatment after the preparation of the respective castings for homogenization. The castings were heated at a temperature of 430° C. and maintained at that temperature for 9 hours. After said heat treatment, the samples were cooled in air at ambient temperature.

The heat treated samples were also tested for the tensile strength, yield strength and elongation in the same manner as the untreated samples (see above). All test results are summarized in Table 2 below.

TABLE 2

| Property | Sand mold casting | |
|---|---|---|
| $R_m$ [MPa] | 178 | 320 |
| $R_{p0.2}$ [MPa] | 160 | 172 |
| A [%] | 0.5 | 12.0 |
| Heat treatment | —/— | 430° C./9 h/air |

It can be seen from the above test results that the sand mold casting, despite having lower tensile strength, yield strength and elongation in the untreated state compared to the permanent mold casting, both castings are very similar in their mechanical properties after the heat treatment.

Microstructural investigation of the sample revealed that the homogenization did not affect the Mg concentration within the grains, i.e., there was no balancing of Mg concentration within the grains. The Mg content was still lower at the core of the grain, compared to the grain boundary. This can be seen from the EDX analysis of the sample after homogenization. FIG. 1 shows a cross section of the sample after homogenization.

The sample was cut, and the resulting cutting area was several times precision ground and then polished. The final cutting area was investigated in an electron microscope, resulting in the REM picture of FIG. 1. The magnification is 250 times, the working distance between optical lens and surface of the final cutting area was 10 mm, the emission current was 75 μA, and the beam current was 3.5 nA.

An EDX analysis was made along the line as indicated in FIG. 1. The respective intensities for the metals aluminum (a), magnesium (b), iron (c) and copper (d) are shown in the corresponding FIG. 2. All x-ray measurements were made in accordance with DIN EN ISO 17636-1:2013-05, setting the parameters for magnesium and then adapting for aluminum, as there are no parameters for aluminum in the specification. The assessment of the x-ray films was then made in accordance with ASTM E2422-17 and ASTM E2869-17.

These results were confirmed by a DSC analysis of a further sample as shown in Example 3 below.

Example 3: DSC Analysis

The transformation of the sample during heat treatment was further investigated using DSC.

A bar of 18 mm thickness was cast using alloy No. 1 of Example 1. Said bar was not heat treated.

The sample was analyzed using heat-flux DSC. Two identical crucibles were put into a furnace and were subjected to the same time-temperature profile. One of the crucibles was provided with the sample ("sample crucible"), the other was left empty ("reference crucible"). The furnace was then heated at a rate of 2° C./min. The temperature range for the analysis was set in the range of 50° C. to 525° C. Thermal processes in a sample result in a temperature difference (ΔT) between the temperature of the sample crucible ($T_{sample}$) and the temperature of the reference crucible ($T_{reference}$):

$$\Delta T - T_{sample} - T_{reference}$$

Figure 3:
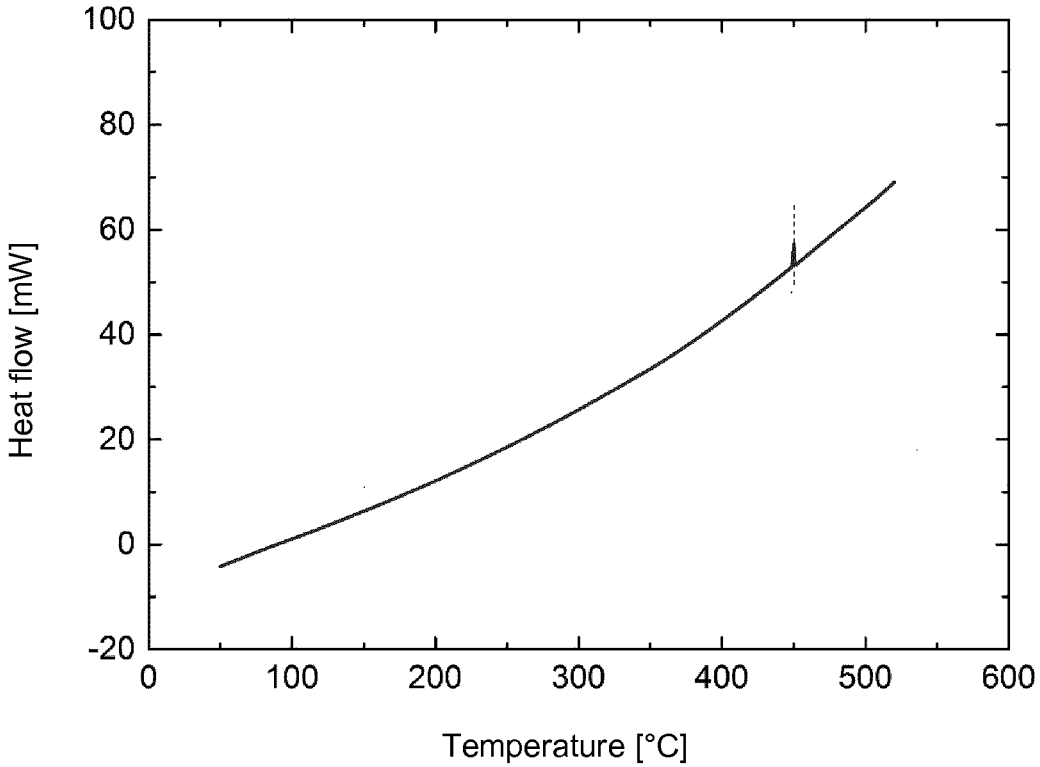
FIG. 3: DSC analysis showing the heat flow of a sample according to Example 3.

The temperature curve showed a steady increase of the temperature until 450° C. The curve then has a steep increase, and after reaching the maximum, the curve as a steep decrease again (see FIG. 3). A repetition of the measurement with the same sample did not show the increase in temperature any more. Said increase in temperature is an indication for an exothermal process taking place in the sample at about 450° C.

Example 4: Properties of Aluminum Alloys

Plates with the thickness specified in Table 4 below were prepared using sandcasting method. These plates were subjected to different tests as specified below in Table 4 resulting in the tensile strength ($R_m$), the yield strength ($R_{p0.2}$) and the elongation (A).

Example 5: Heat Treatment

According to the method as described in Example 2, the mechanical properties of alloy No. 3 of Example 1 were further investigated with respect to an optional heat treatment. In contrast to Example 2, the samples were prepared by permanent mold casting and the heat treatment was performed at 450° C. for 24 hours.

The determined tensile strength, yield strength and elongation of the samples are summarized in Table 3 below.

TABLE 4

| Property | Permanent mold casting | |
|---|---|---|
| $R_m$ [MPa] | 216 | 400 |
| $R_{p0.2}$ [MPa] | 167 | 202 |
| A [%] | 0.7 | 25.1 |
| Heat treatment | —/— | 450° C./24 h/air |

TABLE 4

| No. | Property | Thickness [mm] | | | | | | |
|---|---|---|---|---|---|---|---|---|
| | | 6 | 9 | 12 | 15 | 18 | 21 | 30 |
| 1 | tensile strength [MPa] | 382 | 380 | 378 | 373 | 362 | 327 | 277 |
| | yield strength [MPa] | 178 | 179 | 192 | 177 | 177 | 174 | 162 |
| | elongation [%] | 34.7 | 36.9 | 35.1 | 34.0 | 23.0 | 15.20 | 9.6 |
| 2 | tensile strength [MPa] | 429 | 427 | 341 | 330 | 330 | 296 | 280 |
| | yield strength [MPa] | 220 | 219 | 220 | 200 | 206 | 207 | 189 |
| | elongation [%] | 25.7 | 24.5 | 7.4 | 8.7 | 8.6 | 5.0 | 5.6 |

The samples were prepared and tested in accordance with DIN 50125:2009 and DIN EN ISO 6892-1:2009 at room temperature (23° C.).

The present disclosure also pertains to the following numbered items:

1. An aluminum alloy comprising
   a. from 9 to 14% by mass of magnesium (Mg);
   b. from 0.011 to 1% by mass of titanium (Ti);
   c. 0.1% by mass or less of manganese (Mn); and
   d. 0.1% by mass or less of iron (Fe);
   e. from 0.001 to 0.1% by mass of beryllium (Be);
   with the balance being aluminum (Al);
   each in relation to the total mass of the alloy composition, and wherein all compounds of the alloy add up to a total of 100% by mass.

2. The aluminum alloy according to item 1, wherein the aluminum alloy comprises
   a. from 9 to 14% by mass of magnesium (Mg);
   b. from 0.011 to 1% by mass of titanium (Ti);
   c. 0.1% by mass or less of manganese (Mn);
   d. 0.1% by mass or less of iron (Fe);
   e. from 0.001 to 0.1% by mass of beryllium (Be);
   f. from 0.0009 to 0.2% by mass of boron (B); and
   g. 0.01% by mass or less of copper (Cu);
   with the balance being aluminum (Al);
   each in relation to the total mass of the alloy composition, and wherein all compounds of the alloy add up to a total of 100% by mass.

3. The aluminum alloy according to item 1 or 2, wherein the aluminum alloy further comprises 1% by mass or less of silicon (Si) and 0.01% by mass or less of zinc (Zn).

4. The aluminum alloy according to any one of items 1 to 3, wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

5. The aluminum alloy according to any one of items 1 to 4, wherein Mg is present in an amount of from 9.1 to 13.9% by mass, preferably in an amount of from 9.2 to 13% by mass, preferably in an amount of from 9.5 to 12% by mass, preferably in an amount of from 10.2 to 11.8% by mass, or in an amount of from 9.2 to 10.2% by mass, or in an amount of from 9.6 to 10.2% by mass.

6. The aluminum alloy according to any one of items 1 to 5, wherein Mg is present preferably in an amount of from 9.8 to 11% by mass, or preferably in an amount of from 10.2% to 13% by mass.

7. The aluminum alloy according to any one of items 1 to 6, wherein Ti is present i) in an amount of from 0.011 to 0.9% by mass, preferably in an amount of from 0.012 to 0.8% by mass, preferably in an amount of from 0.013 to 0.5% by mass, or in an amount of 0.011% by mass or more; and/or ii) in an amount of 0.015% by mass or more, or in an amount of 0.15% by mass or more, or in an amount of 0.2% by mass or more, or in an amount of 0.3% by mass or more; and/or iii) in an amount of 0.9% by mass or less, or in an amount of 0.8% by mass or less, or in an amount of 0.7% by mass or less, or in an amount of 0.6% by mass or less, or in an amount of 0.4% by mass or less.

8. The aluminum alloy according to any one of items 1 to 7, wherein Mn is present i) in an amount of 0.09% by mass or less, preferably in an amount of 0.08% by mass or less, preferably in an amount of 0.04% by mass or less, preferably in an amount of 0.005% by mass or less; and/or ii) in an amount of 0.0001% by mass or more, preferably in an amount of 0.0005% by mass or more.

9. The aluminum alloy according to any one of items 1 to 8, wherein Fe is present i) in an amount of 0.09% by mass or less, preferably in an amount of 0.08% by mass or less, preferably in an amount of 0.05% by mass or less, preferably in an amount of 0.03% by mass or less; and/or ii) in an amount of 0.01% by mass or more, preferably in an amount of 0.05% by mass or more.

10. The aluminum alloy according to any one of items 1 to 9, wherein Be is present i) in an amount of from 0.002 to 0.09% by mass, preferably in an amount of from 0.003 to 0.08% by mass, preferably in an amount of from 0.007 to 0.06% by mass; and/or ii) in an amount of 0.002% by mass or more, or in an amount of 0.003% by mass or more, or in an amount of 0.004% by mass or more; and/or iii) in an amount of 0.09% by mass or less, or in an amount of 0.08% by mass or less, or in an amount of 0.07% by mass or less, or in an amount of 0.06% by mass or less, or in an amount of 0.04% by mass or less.

11. The aluminum alloy according to any one of items 1 to 10, wherein Be is present in an amount of from 0.005% by mass or more, or in an amount of 0.015% by mass or more.

12. The aluminum alloy according to any one of items 1 to 11, wherein boron (B) is present i) in an amount of from 0.0009 to 0.2% by mass, preferably in an amount of from 0.001 to 0.15% by mass, preferably in an amount of from 0.006 to 0.1% by mass, preferably in an amount of from 0.01 to 0.1% by mass, preferably in an amount of from 0.015 to 0.05% by mass; and/or ii) in an amount of 0.0009% by mass or more, or in an amount of 0.001% by mass or more, or in an amount of 0.006% by mass or more; and/or iii) in an amount of 0.1% by mass or less, or in an amount of 0.08% by mass or less, or in an amount of 0.07% by mass or less, or in an amount of 0.06% by mass or less, or in an amount of 0.04% by mass or less.

13. The aluminum alloy according to any one of items 1 to 12, wherein boron (B) is present in an amount of 0.03% by mass or more.

14. The aluminum alloy according to any one of items 1 to 13, wherein silicon (Si) is present i) in an amount of 1% by mass or less, preferably in an amount of 0.5% by mass or less, preferably in an amount of 0.3% by mass or less, preferably in an amount of 0.2% by mass or less, preferably in an amount of 0.15% by mass or less, preferably in an amount of 0.1% by mass or less; and/or ii) in an amount of 0.01% by mass or more, preferably in an amount of 0.03% by mass or more, preferably in an amount of 0.05% by mass or more, preferably in an amount of 0.07% by mass or more.

15. The aluminum alloy according to any one of items 1 to 14, wherein copper (Cu) is present i) in an amount of 0.01% by mass or less, preferably in an amount of 0.005% by mass or less, preferably in an amount of 0.003% by mass or less; and/or ii) in an amount of 0.0001% by mass or more, preferably in an amount of 0.0005% by mass or more.

16. The aluminum alloy according to any one of items 1 to 15, wherein zinc (Zn) is present i) in an amount of 0.01% by mass or less, preferably in an amount of 0.008% by mass or less, preferably in an amount of 0.007% by mass or less; and/or ii) in an amount of 0.001% by mass or more, preferably in an amount of 0.003% by mass or more.

17. The aluminum alloy according to any one of items 1 to 16, comprising a. from 9 to 14% by mass of Mg;
b. from 0.011 to 1% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

18. The aluminum alloy according to any one of items 1 to 17, comprising a. from 9.5 to 12% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;

g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

19. The aluminum alloy according to any one of items 1 to 18, comprising
a. from 9.5 to 12% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.3% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

20. The aluminum alloy according to any one of items 1 to 19, comprising
a. from 9.5 to 12% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.3% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

21. The aluminum alloy according to any one of items 1 to 20, comprising
a. from 9.5 to 12% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.3% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

22. The aluminum alloy according to any one of items 1 to 21, comprising
a. from 10.2 to 11.8% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

23. The aluminum alloy according to any one of items 1 to 22, comprising
a. from 10.2 to 11.8% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

24. The aluminum alloy according to any one of items 1 to 23, comprising a. from 10.2 to 11.8% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

25. The aluminum alloy according to any one of items 1 to 24, comprising a. from 10.2 to 11.8% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

26. The aluminum alloy according to any one of items 1 to 25, comprising a. from 10.2 to 11.8% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

27. The aluminum alloy according to any one of items 1 to 26, comprising a. from 10.2 to 11.8% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

28. The aluminum alloy according to any one of items 1 to 27, comprising a. from 10.2 to 11.8% by mass of Mg;
b. from 0.013 to 0.5% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;

with the balance being Al;

each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

29. The aluminum alloy according to any one of items 1 to 28, comprising
a. from 10.2 to 11.8% by mass of Mg;
b. from 0.013 to 0.5% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

30. The aluminum alloy according to any one of items 1 to 29, comprising
a. from 9.6 to 10.2% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

31. The aluminum alloy according to any one of items 1 to 30, comprising
a. from 9.6 to 10.2% by mass of Mg;
b. from 0.012 to 0.8% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

32. The aluminum alloy according to any one of items 1 to 31, comprising
a. from 9.6 to 10.2% by mass of Mg;
b. from 0.012 to 0.8% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

33. The aluminum alloy according to any one of items 1 to 32, comprising
a. from 9.6 to 10.2% by mass of Mg;
b. from 0.012 to 0.8% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

34. The aluminum alloy according to any one of items 1 to 33, comprising
a. from 9.6 to 10.2% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;

g. 1% by mass or less of Si;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

35. The aluminum alloy according to any one of items 1 to 34, comprising
a. from 9.6 to 10.2% by mass of Mg;
b. from 0.013 to 0.5% by mass of Ti;
c. from 0.001 to 0.1% by mass of Be;
d. 0.1% by mass or less of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

36. The aluminum alloy according to any one of items 1 to 35, comprising
a. from 9.6 to 10.2% by mass of Mg;
b. from 0.013 to 0.5% by mass of Ti;
c. from 0.003 to 0.08% by mass of Be;
d. from 0.0005 to 0.08% by mass of Mn;
e. 0.1% by mass or less of Fe;
f. from 0.0009 to 0.2% by mass of B;
g. 0.5% by mass or less of Si, preferably in an amount of 0.2% by mass or less;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

37. The aluminum alloy according to any one of items 1 to 36, comprising
a. from 9.6 to 10.2% by mass of Mg;
b. from 0.013 to 0.5% by mass of Ti;
c. from 0.003 to 0.08% by mass of Be;
d. from 0.0005 to 0.08% by mass of Mn;
e. from 0.001 to 0.1% by mass of Fe;
f. from 0.0009 to 0.2% by mass of B;
g. from 0.03 to 0.5% by mass of Si, preferably from 0.003 to 0.15% by mass;
h. 0.01% by mass or less of Cu; and
i. 0.01% by mass or less of Zn;
with the balance being Al;
each in relation to the total mass of the alloy composition, and wherein all compounds of the alloy add up to a total of 100% by mass; wherein the aluminum alloy comprises inevitable impurities, preferably wherein the inevitable impurities are present in an amount of less than 0.15% by mass, preferably in an amount of less than 0.1% by mass, further preferably in an amount of less than 0.05% by mass, and each individual impurity is present in an amount of less than 0.05% by mass, preferably in an amount of less than 0.01% by mass, further preferably in an amount of less than 0.001% by mass.

38. Method for the preparation of an aluminum alloy according to any one of items 1 to 37, comprising the steps of
a. Providing a raw aluminum;
b. Heating the raw aluminum to a temperature in the range of from 650 to 800° C., preferably from 700 to 770° C.;
c. Adding Mg and Be to result in a raw alloy;
d. Optionally degassing the raw alloy;
e. Adding Ti to the optionally degassed raw alloy to prepare the aluminum alloy.

39. Method for the preparation of an aluminum alloy according to any one of items 1 to 37, comprising the steps of
a. Providing a raw aluminum;
b. Heating the raw aluminum to a temperature in the range of from 650 to 800° C., preferably from 700 to 770° C.;
c. Adding Mg and Be to result in a raw alloy;
d. Optionally degassing the raw alloy;
e. Adding Ti and B to the optionally degassed raw alloy to prepare the aluminum alloy in liquid form.

40. The method according to item 39, wherein the method further comprises the steps of
f. Casting the liquid aluminum alloy into a mold;
g. Removing the mold to provide an aluminum casting;
h. Optionally forming and/or treating the aluminum casting.

41. Method for the manufacture of an aluminum casting, comprising the steps of
a. Providing a mold and an aluminum alloy according to any one of items 1 to 39;
b. Melting the aluminum alloy to provide a liquid aluminum alloy;
c. Casting the liquid aluminum alloy into the mold;
d. Removing the mold to provide an aluminum casting;
e. Optionally forming and/or treating the aluminum casting.

42. Method according to items 40 or 41, wherein the casting is selected from the group consisting of sand casting, plaster mold casting, shell casting, lost-wax casting, evaporative-pattern casting, permanent mold casting, die casting, semi-solid metal casting, centrifugal casting, and continuous casting.

43. Method according to any one of items 40 to 42, wherein the aluminum casting is formed by a method selected from the group consisting of rolling, extruding, die forming, forging, stretching, bending and shear forming.

44. Method according to any one of items 40 and 42 to 43, wherein the casting is heat treated in step h. by heating the casting to a temperature of at least 380° C., or at least 400° C., or at least 430° C., or at least 450° C., for a period of less than 1 hour, or less than 3 hours, or less than 5 hours, or less than 8 hours, or less than 12 hours, or less than 18 hours, or less than 24 hours, preferably less than 12 hours, or preferably less than 18 hours, or for a period of at least 10 minutes, or at least 1 hour, or at least 3 hours, or at least 8 hours, or at least 12 hours, or at least 24 hours, and then cooled in air at ambient temperature.

45. Method according to any one of items 41 to 43, wherein the casting is heat treated in step e. by heating the casting to a temperature of at least 380° C., or at least 400° C., or at least 430° C., or at least 450° C., for a period of at least 10 minutes, or at least 1 hour, or at least 8 hours, or at least 24 hours, and then cooled in air at ambient temperature.

46. Aluminum alloy product prepared by a method according to any one of items 40 to 45.

47. Aluminum alloy product comprising an aluminum alloy according to any one of items 1 to 37, and/or prepared by a method according to any one of items 40 to 45, wherein i) at least parts of the product have a thickness in the range of from 1 to 23 mm, preferably 3 to 15 mm, preferably from 6 to 12 mm, preferably from 6 to 9 mm; or 1 to 10 mm, preferably 3 to 10 mm; and/or ii) the aluminum of the product has a tensile strength of at least 290 MPa, preferably at least 320 MPa, preferably at least 360 MPa, preferably at least 370 MPa, preferably at least 380 MPa; and/or iii) the aluminum of the product has a yield strength of at least 170 MPa, preferably at least 180 MPa, preferably at least 200 MPa, preferably at least 215 MPa; and/or iv) the aluminum of the product has elongation of at least 5%, preferably at least 15%, preferably at least 20%, preferably at least 30%, preferably at least 34%.

48. The aluminum alloy product according to item 47, wherein i) the aluminum of the product has a tensile strength, measured at a thickness of from 1 to 23 mm, preferably 3 to 15 mm, preferably from 6 to 12 mm, preferably from 6 to 9 mm; or 1 to 10 mm, preferably 3 to 10 mm, of at least 290 MPa, preferably at least 320 MPa, preferably at least 360 MPa, preferably at least 370 MPa, preferably at least 380 MPa; and/or ii) the aluminum of the product has a yield strength, measured at a thickness of from 1 to 23 mm, preferably 3 to 15 mm, preferably from 6 to 12 mm, preferably from 6 to 9 mm; or 1 to 10 mm, preferably 3 to 10 mm, of at least 170 MPa, preferably at least 180 MPa, preferably at least 200 MPa, preferably at least 215 MPa; and/or iii) the aluminum of the product has elongation, measured at a thickness of from 1 to 23 mm, preferably 3 to 15 mm, preferably from 6 to 12 mm, preferably from 6 to 9 mm; or 1 to 10 mm, preferably 3 to 10 mm, of at least 5%, preferably at least 15%, preferably at least 20%, preferably at least 30%, preferably at least 34%.

49. Aluminum alloy product comprising an aluminum alloy according to any one of items 1 to 29, and/or prepared by a method according to any one of items 40 to 45, wherein i) at least parts of the product have a thickness in the range of from 1 to 10 mm, preferably 3 to 10 mm, preferably from 6 to 9 mm; and/or ii) the aluminum of the product has a tensile strength of at least 380 MPa, preferably at least 400 MPa, preferably at least 420 MPa; and/or iii) the aluminum of the product has a yield strength of at least 200 MPa, preferably at least 215 MPa; and/or iv) the aluminum of the product has elongation of at least 20%, preferably at least 24%.

50. The aluminum alloy product according to item 49, wherein i) the aluminum of the product has a tensile strength, measured at a thickness of from 1 to 10 mm, preferably 3 to 10 mm, preferably from 6 to 9 mm, of at least 380 MPa, preferably at least 400 MPa, preferably at least 420 MPa; and/or ii) the aluminum of the product has a yield strength, measured at a thickness of from 1 to 10 mm, preferably 3 to 10 mm, preferably from 6 to 9 mm, of at least 200 MPa, preferably at least 215 MPa; and/or iii) the aluminum of the product has elongation, measured at a thickness of from 1 to 10 mm, preferably 3 to 10 mm, preferably from 6 to 9 mm, of at least 20%, preferably at least 24%.

51. Aluminum alloy product comprising an aluminum alloy according to any one of items 1 to 21 and 30 to 37, and/or prepared by a method according to any one of items 40 to 45, wherein i) at least parts of the product have a thickness in the range of from 1 to 23 mm, preferably 3 to 15 mm, preferably from 6 to 12 mm, preferably from 6 to 9 mm; and/or ii) the aluminum of the product has a tensile strength of at least 290 MPa, preferably at least 320 MPa, preferably at least 360 MPa, preferably at least 370 MPa, preferably at least 380 MPa; and/or iii) the aluminum of the product has a yield strength of at least 170 MPa, preferably at least 180 MPa; and/or iv) the aluminum of the product has elongation of at least 5%, preferably at least 15%, preferably at least 20%, preferably at least 30%, preferably at least 34%.

52. The aluminum alloy product according to item 51, wherein i) the aluminum of the product has a tensile strength, measured at a thickness of from 1 to 23 mm, preferably 3 to 15 mm, preferably from 6 to 12 mm, preferably from 6 to 9 mm, of at least 290 MPa, preferably at least 320 MPa, preferably at least 360 MPa, preferably at least 370 MPa, preferably at least 380 MPa; and/or ii) the aluminum of the product has a yield strength, measured at a thickness of from 1 to 23 mm, preferably 3 to 15 mm, preferably from 6 to 12 mm, preferably from 6 to 9 mm, of at least 170 MPa, preferably at least 180 MPa; and/or iii) the aluminum of the product has elongation, measured at a thickness of from 1 to 23 mm, preferably 3 to 15 mm, preferably from 6 to 12 mm, preferably from 6 to 9 mm, of at least 15%, preferably at least 20%, preferably at least 30%, preferably at least 34%.

The invention claimed is:

1. An aluminum alloy, comprising:

a. from 9 to 14% by mass of magnesium (Mg);

b. from 0.15 to 1% by mass of titanium (Ti);

c. from 0.0001 to 0.1% by mass of manganese (Mn);

d. from 0 to 0.1% by mass of iron (Fe);

e. from 0.001 to 0.1% by mass of beryllium (Be);

f. from 0.0009 to 0.2% by mass of boron (B);

g. from 0 to 0.01% by mass of copper (Cu);

h. from 0 to 0.5% by mass of silicon (Si); and i. from 0 to 0.01% by mass of zinc (Zn), and inevitable impurities in a total amount of less than 0.15% by mass, with the balance being aluminum (Al);

wherein each is in relation to the total mass of the aluminum alloy, and wherein all compounds a. through i., Al plus inevitable impurities of the aluminum alloy add up to a total of 100% by mass; and wherein said aluminum alloy has an elongation of at least 20%.

2. The aluminum alloy according to claim 1, wherein the aluminum alloy comprises inevitable impurities, wherein each individual impurity is present in an amount of less than 0.05% by mass.

3. The aluminum alloy according to claim 1, wherein Mg is present in an amount of from 9.1 to 13.9% by mass.

4. The aluminum alloy according to claim 1, wherein Ti is present in an amount of from 0.2 to 0.9% by mass.

5. The aluminum alloy according to claim 1, wherein Mn is present in an amount of from 0.0005 to 0.09% by mass.

6. The aluminum alloy according to claim 1, wherein Fe is present in an amount of from 0.01 to 0.09% by mass.

7. The aluminum alloy according to claim 1, wherein Be is present in an amount of from 0.002 to 0.09% by mass.

8. The aluminum alloy according to claim 1, wherein Bis present in an amount of from 0.001 to 0.15% by mass.

9. The aluminum alloy according to claim 1, wherein Si is present in an amount of from 0.01 to 0.5% by mass.

10. The aluminum alloy according to claim 1, wherein Cu is present in an amount of 0.0001 to 0.005% by mass.

11. The aluminum alloy according to claim 1, wherein Zn is present in an amount of from 0.001 to 0.01% by mass.

12. The aluminum alloy according to claim 2, wherein the inevitable impurities are present in an amount of less than 0.05% by mass, and wherein each individual impurity is present in an amount of less than 0.001% by mass.

13. The aluminum alloy according to claim 1, wherein said aluminum alloy has a tensile strength of at least 290 MPa.

14. The aluminum alloy according to claim 1, wherein said aluminum alloy has a yield strength of at least 170 MPa.

15. The aluminum alloy according to claim 1, wherein said aluminum alloy has an elongation of at least 30%.

16. The aluminum alloy according to claim 1, wherein the elongation is determined after said aluminum alloy was heat treated at a temperature of at least 380° C. for at least 1 h.

17. The aluminum alloy according to claim 1, wherein the elongation is determined after said aluminum alloy was heat treated at a temperature of at least 430° C. for at least 3 h.

18. The aluminum alloy according to claim 1, wherein the elongation is determined after said aluminum alloy was heat treated at a temperature of at least 450° C. for at least 3 h.

* * * * *